US009835125B2

(12) United States Patent
Rehwald et al.

(10) Patent No.: US 9,835,125 B2
(45) Date of Patent: Dec. 5, 2017

(54) RETAINER FOR FASTENING A FUEL DISTRIBUTOR TO AN INTERNAL COMBUSTION ENGINE AND SYSTEM HAVING SUCH A RETAINER

(71) Applicant: Robert Bosch GmbH, Stuttgart (DE)

(72) Inventors: Andreas Rehwald, Bietigheim-Bissingen (DE); Klaus Lang, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 53 days.

(21) Appl. No.: 14/785,958

(22) PCT Filed: Feb. 26, 2014

(86) PCT No.: PCT/EP2014/053701
§ 371 (c)(1),
(2) Date: Oct. 21, 2015

(87) PCT Pub. No.: WO2014/173561
PCT Pub. Date: Oct. 30, 2014

(65) Prior Publication Data

US 2016/0069314 A1 Mar. 10, 2016

(30) Foreign Application Priority Data

Apr. 23, 2013 (DE) ..... 10 2013 207 368

(51) Int. Cl.
*F02M 63/02* (2006.01)
*F02M 55/02* (2006.01)
(Continued)

(52) U.S. Cl.
CPC ..... *F02M 63/0275* (2013.01); *F02M 55/025* (2013.01); *F02M 69/465* (2013.01); *F02F 7/008* (2013.01); *F02M 2200/09* (2013.01)

(58) Field of Classification Search
CPC ..... F02M 63/0275; F02M 55/025; F02M 69/465; F02M 2200/09; F02F 7/008
(Continued)

(56) References Cited

U.S. PATENT DOCUMENTS 4,975,008 A * 12/1990 Wagner ..... F02B 77/00 411/337
5,044,338 A * 9/1991 Shelton ..... F02M 69/465 123/456
(Continued)

FOREIGN PATENT DOCUMENTS

| | | |
|---|---|---|
| DE | 10 2010 046344 | 6/2011 |
| WO | WO 91/11607 | 8/1991 |
| WO | WO 2013/063408 | 5/2013 |

OTHER PUBLICATIONS

International Search Report for PCT/EP2014/053701, dated Apr. 15, 2014.

*Primary Examiner* — Carlos A Rivera
*Assistant Examiner* — Anthony Taylor, Jr.
(74) *Attorney, Agent, or Firm* — Norton Rose Fulbright US LLP; Gerard Messina

(57) ABSTRACT

A retainer for fastening a component, especially a fuel distributor, via a holding element to an internal combustion engine includes: decoupling elements, a fastening body and a fastening element. The fastening body is fastened to the internal combustion engine with the aid of the fastening element. In addition, the holding element is fastened to the fastening body via the decoupling elements. Moreover, a preloading element is provided that is joined to the fastening body, preloading of the decoupling elements being set by way of a predefined position of the preloading element relative to the fastening body in which the preloading element is joined to the fastening body.

10 Claims, 5 Drawing Sheets

(51) Int. Cl.
*F02M 69/46* (2006.01)
*F02F 7/00* (2006.01)

(58) Field of Classification Search
USPC ..... 123/195 A
See application file for complete search history.

(56) References Cited

U.S. PATENT DOCUMENTS

| | | | | |
|---|---|---|---|---|
| 6,591,801 | B1 | 7/2003 | Fonville | |
| 6,863,054 | B2 * | 3/2005 | Reiter | F02M 51/005 123/456 |
| 7,765,984 | B2 * | 8/2010 | Fuerst | F02M 55/025 123/456 |
| 8,307,809 | B2 * | 11/2012 | Hay | F02M 55/025 123/198 E |
| 2007/0163545 | A1 * | 7/2007 | Beardmore | F02M 55/025 123/456 |
| 2010/0012091 | A1 * | 1/2010 | Kannan | F02M 55/004 123/447 |
| 2011/0155824 | A1 * | 6/2011 | Fischer | F02M 61/14 239/533.2 |
| 2013/0104852 | A1 * | 5/2013 | Kannan | F02M 61/168 123/456 |
| 2013/0125864 | A1 * | 5/2013 | Kannan | F02M 61/168 123/469 |

* cited by examiner

RETAINER FOR FASTENING A FUEL DISTRIBUTOR TO AN INTERNAL COMBUSTION ENGINE AND SYSTEM HAVING SUCH A RETAINER

BACKGROUND OF THE INVENTION

1. Field of the Invention

The present invention relates to a retainer for fastening a component, especially a fuel distributor, to an internal combustion engine, as well as a system that preferably is a fuel-injection system or a part of a fuel-injection system. The invention relates especially to the domain of fuel-injection systems of internal combustion engines, where fuel under high pressure is injected into assigned combustion chambers of the internal combustion engine via fuel injectors.

2. Description of the Related Art

The published German Patent Application document DE 10 2010 046 344 A1 describes an engine assembly having a fuel rail. The engine assembly includes a cylinder head, a cam cover and a fuel-rail assembly. The fuel-rail assembly has the fuel rail, a clamp assembly and a fuel-injection device. The fuel rail of the engine assembly is attached to the cam cover. Meanwhile, the clamp assembly is secured to the fuel rail, it including a fastening element and an insulation element. The fastening element engages with the cam cover and secures the fuel rail to it. In one possible development, the fastening assembly may have fastening elements, spacers and a sleeve as well as a first and a second insulation element. The fastening elements have a head and a shank having a threaded area that engages with an opening in the cam cover in order to secure the fuel rail to the cam cover. The fastening element extends through the sleeve. The first insulation element is situated axially between a first side of the clamp and the cam cover. The second insulation element is situated axially between the second side of the clamp and the head of the fastening element. The insulation elements may be formed of an elastomer material that provides damping.

The engine assembly described in the published German Patent Application document DE 10 2010 046 344 A1 has the disadvantage that the insulation elements made of the elastomer material are secured by the head of the fastening element, which is screwed into the cam cover, via the spacer. Thus, both the attachment to the cam cover and the fixation of the insulation elements are effected by the fastening element. Since the tightening torque of the fastening element must be great, two possible cases are therefore possible with regard to dimensioning of the spacer. If the spacer is somewhat too short, a play of the clamp then results between the insulation elements, which impairs functioning considerably, so that this case must be avoided. If, taking possible tolerances into consideration, the spacer is made somewhat too long, then high compression of the insulation elements results locally, which cannot be avoided because of the high tightening torque required. This high compression then leads to a local component fatigue at the insulation elements, namely, in the area of the spacer on one hand, and on the other hand, at a graduated area of a sleeve against which the first insulation element is supported. A certain variance subject to tolerance results in this connection. External areas no longer contribute here to the fixation of the clamp relative to the insulation elements, since the support partners are lacking here, that is, the preloading disappears. This also has an unfavorable effect on the possible vibration damping. A variance occurs subject to tolerance in this case, as well.

BRIEF SUMMARY OF THE INVENTION

The retainer according to the present invention and the system of the present invention have the advantage that they permit improved vibration damping. In particular, a suitable adjustment of the vibration damping may be carried out in view of the specific application case.

The retainer according to the present invention may also be produced and marketed independently of the component, especially the fuel distributor. The component, especially the fuel distributor, and the holding element are not necessarily parts of the retainer according to the present invention. In mounting the system, especially a fuel-injection system, on an internal combustion engine, the retainer may in particular be joined on one hand to the component and on the other hand to the internal combustion engine. During assembly, the preloading element may then be joined to the fastening body. By joining the preloading element to the fastening body, the position of the preloading element relative to the fastening body is then defined, and the preloading of the decoupling element is set. In this context, a force which determines the preloading of the decoupling element may be applied to the preloading element via an assembly appliance, for example. Meanwhile, the connection between the preloading element and the fastening body may be formed in suitable manner. After the connection is formed, the assembly force may then be reduced again. In this connection, the tightening torque for the fastening means or a fastening force produced by the fastening means to secure the fastening body to the internal combustion engine is independent of the assembly force for preloading the decoupling element. This is because the fastening means and the fastening body lie in a force path which is independent of a force path in which the preloading element, the decoupling element and the fastening body lie. The force transmission only takes place both times via the fastening body.

The system preferably is formed as a fuel-injection system or part of a fuel-injection system. Thus, it is preferably a system that is a fuel-injection system or a part of a fuel-injection system. The internal combustion engine or parts of the internal combustion engine are not necessarily parts of the system. However, a part of the retainer, especially the fastening body or a part of the fastening body, may also be mounted on the internal combustion engine by pre-assembly, for example. Moreover, the retainer may also be connected to the internal combustion engine via further component parts, especially add-on parts. Thus, an adaptation to the specific application case is possible. The holding element may be formed as a separate holding element and joined to the component, especially the fuel distributor. However, the holding element may also be a part of the component, especially of the fuel distributor. For example, the holding element may be formed by a suitable formation of a housing part of the component. Thus, a wide field of application is given in this respect, as well.

It is advantageous that the preloading element has an inner contact surface with which the preloading element abuts against an outer surface of the fastening body. Guidance of the preloading element on the outer surface of the fastening body is thereby ensured, prior to the preloading element being joined to the fastening body. When the preloading element is impinged upon, which serves to preload the decoupling element, a uniform introduction of force onto the decoupling element is therefore possible. In particular, tilting of the preloading element, which leads to a non-uniform introduction of force onto the decoupling element, is thereby avoided.

It is also advantageous that a depression is provided on the outer surface of the fastening body, that the preloading element has a deformable projection, and that the deformable projection and the depression of the fastening body are shaped in such a way that the preloading element is able to be joined to the fastening body by flanging. A plurality of depressions may also be provided here, which preferably are distributed circumferentially relative to a longitudinal axis of the fastening body, on the outer surface of the fastening body. This permits an advantageous connection, since in this way, the individual fastening points, which are formed by flanging, are stressed at least approximately parallel to the longitudinal axis, and a tilting moment between the preloading element and the fastening body, which occurs in the case of a single connecting point, is avoided. However, due to the guidance of the preloading element on the outer surface of the fastening body, a reliable connection may also be ensured by a single connecting point at which the connection between the preloading element and the fastening body is formed by flanging, where it is possible in the specific application case.

It is further advantageous that the inner contact surface of the preloading element and the outer surface of the fastening body are shaped in such a way that a sliding fit is formed between the inner contact surface of the preloading element and the outer surface of the fastening body. In the case of this embodiment, the tightest possible guidance of the preloading element on the outer surface of the fastening body is attained, so that upon preloading, the desired end position in which the connection of the preloading element to the fastening body is formed, is able to be maintained in an easy manner without relative movements occurring between the preloading element and the fastening body during the joining process. This facilitates the formation of the connection between the preloading element and the fastening body and permits a high quality of the connection, depending upon the type of connection, especially in the case of welding.

In a further development, it is advantageous that the inner contact surface of the preloading element and the outer surface of the fastening body are shaped in such a way that the preloading element is able to be joined to the fastening body by a press fit formed between the inner contact surface of the preloading element and the outer surface of the fastening body. The preloading of the decoupling element is able to be ensured by the press fit alone or possibly in conjunction with a further joining process.

It is advantageous that a supporting element is provided, that the supporting element is joined to the fastening body or is encompassed by the fastening body, and that the decoupling element is able to be preloaded at least indirectly against the supporting element by the preloading element. The supporting element may thus be joined in suitable manner as a separate part to the fastening body or may be a part of the fastening body. The preloading element may be supported directly or indirectly on the supporting element. In the preloaded state of the decoupling element, a force transmission adhesion is thus attained via the supporting element and the fastening body.

The decoupling element is advantageously ringlike. The decoupling element is thereby able to surround the fastening body circumferentially. In this manner, in particular, an axially symmetrical form of the decoupling element may be ensured, resulting in a correspondingly symmetrical behavior with respect to vibration damping. However, it is also advantageous that the decoupling element is shaped as an at least approximately rectangularly bent, ringlike decoupling element. In this manner, a special non-symmetrical mode of operation may be predefined for the vibration damping. For example, this is advantageous in the case of correspondingly different stresses. For instance, a fuel distributor in the form of a fuel-distributor rail may be secured to the internal combustion engine via a plurality of retainers. In this case, different vibratory stresses occur in the various spatial directions. In particular, the vibrations or the vibration components may differ in the three spatial directions perpendicular relative to each other, of which one is oriented along the fuel distributor and one is oriented parallel to the longitudinal axis of the fastening body. With regard to the three spatial directions hereby defined, different spring constants of the elastic coupling may then be set via the decoupling element by the design of the decoupling element.

It is also advantageous that the decoupling element is realized in such a way that at least along a preloading direction in which the decoupling element is preloaded owing to the position of the preloading element relative to the fastening body, a non-linear spring characteristic is predefined which describes a dependency of a restoring force, acting on the holding element, on a deflection of the holding element relative to the fastening body. A starting point may then be set in a fashion on the non-linear spring characteristic by the preloading. A frequency-dependent stiffness characteristic, as well as a frequency-dependent damping may also thereby be adapted dynamically by the adjustability via the preloading and possibly the geometry of the decoupling element. This results in an adjustable or tunable transfer function.

Thus, the acoustic properties of the system, especially of the fuel-injection system, may be improved. In addition, the stress on the components used owing to the assembly and as a result of operating temperatures may be reduced. The decoupling elements are implemented advantageously here as spring elements. In particular, viscoelastic decoupling elements may be used. With respect to the specific application case, one individual decoupling element may also be used per retainer. By preference, the fastening is accomplished via a plurality of retainers.

Thus, via the decoupling element or the decoupling elements, a mechanical and possibly also thermal and geometric decoupling of the component relative to the internal combustion engine is/are given in at least one spatial direction. Furthermore, a defined, mechanically damping behavior of the decoupling is made possible in the individual spatial directions. The decoupling elements or the decoupling element are/is preloaded by the setting operation during assembly. This setting operation is carried out independently of the fastening force applied by the fastening means. The preloading may be implemented in one or more spatial directions via one or more intermediate elements, especially the holding element, in doing which, a preloading may be set independently of the tolerances of the individual components.

Consequently, the demands on production as far as tolerances of the individual components are concerned are also reduced.

The preloading may, so to speak, be force-regulated, e.g., via a sliding fit, and/or be set through fastening by welding, flanging or other material-locking or form-locking connection. A form-locking connection may also be attained via a thread that is formed between the preloading element and the fastening body. Adjustability may also be realized in the case of such an embodiment. The preloading may thereby be readjusted after a certain time of service.

However, an adjustment is also possible apropos of an anticipated aging of the decoupling element.

The preferably viscoelastic decoupling by the at least one decoupling element may also be accomplished without screw-like fastening. In this case, snapping, clamping or integration of the decoupling into existing add-on parts such as an intake module, a valve cover, a camshaft gear and other add-ons is likewise possible.

DETAILED DESCRIPTION OF THE INVENTION

Figure 1:
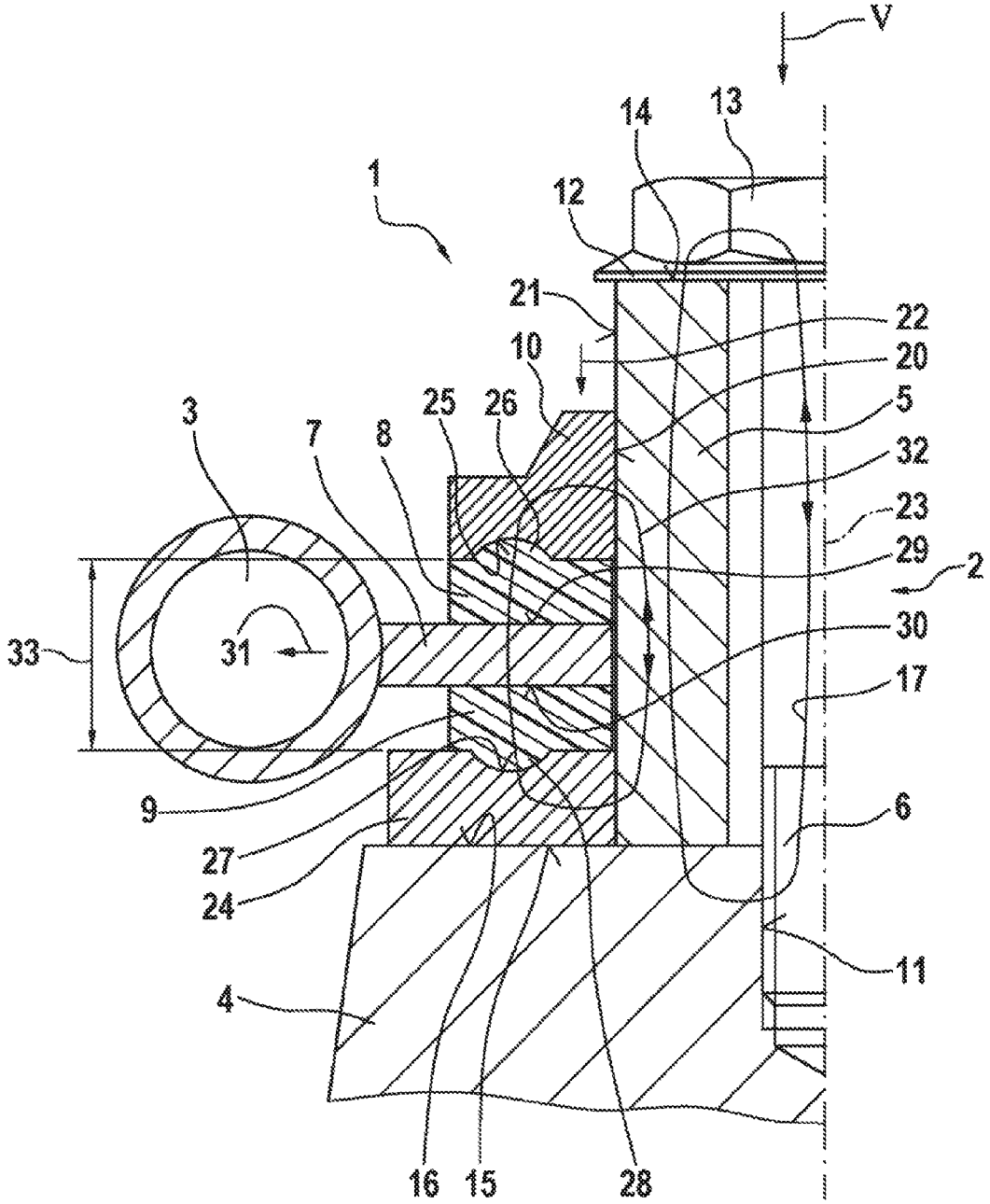
FIG. 1 shows a system having a retainer and a fuel distributor and an internal combustion engine in a partial, schematic sectional view according to a first exemplary embodiment of the present invention.

FIG. 1 shows a system 1 having a retainer 2 and a fuel distributor 3, especially a fuel distributor rail 3, and a portion of an internal combustion engine 4, especially a cylinder head 4, in a partial, schematic sectional view according to a first exemplary embodiment. System 1 is preferably a fuel-injection system 1 or a portion of a fuel-injection system 1.

Retainer 2 has a fastening body 5, a fastening means 6, a holding element 7, decoupling elements 8, 9, and a preloading element 10. Fastening means 6 is screwed into a threaded bore 11. A collar 12 of head 13, which takes the form of a screw head 13, abuts against an end face 14 of fastening body 5. In this manner, fastening body 5 is acted upon with its bottom side 15 against a surface 16 of internal combustion engine 4. The fastening force is generated here by a tightening torque of fastening means 6 in the form of fastening screw 6. In so doing, a force transmission adhesion comes about via fastening means 6 and fastening body 5, which is illustrated by a closed curve 17.

Preloading element 10 has an inner contact surface 20. Preloading element 10 is placed against an outer surface 21 of fastening body 5. In this context, preloading element 10 abuts with its inner contact surface 20 against outer surface 21 of fastening body 5. During assembly, preloading element 10 is displaceable in and counter to a preloading direction 22 relative to fastening body 5, in the course of which, it is guided on outer surface 21. In this connection, preloading direction 22 is oriented parallel to a longitudinal axis 23 of fastening means 6.

In addition, retainer 2 has a supporting element 24, which in this exemplary embodiment, is encompassed by fastening body 5. In a modified embodiment, supporting element 24 may also be joined to fastening body 5. Bottom side 15 is formed at least partially on supporting element 24 in this exemplary embodiment. Thus, supporting element 24 is braced against surface 16 of internal combustion engine 4.

Preloading element 10 has a formation 25 realized as a depression. In addition, decoupling element 8 has a formation 26 realized as bulged formation 26. Decoupling element 8 is inserted with bulged formation 26 into preloading element 10, so that a form-locking connection is created. Formations 25, 26 may also be shaped so as to match each other in another way, in order to create a form-locking connection.

Supporting element 24 has a formation 27 realized as a depression. Decoupling element 9 also has a formation 28 which is bulged. Decoupling element 9 engages with bulged formation 28 in formation 27, so that a form-locking connection is created. Holding element 7 is situated between decoupling elements 8, 9, an upper side 29 of holding element 7 being at least approximately flat in this exemplary embodiment. Furthermore, a lower side 30 of holding element 7 is also at least approximately flat. Between decoupling element 8, which abuts against upper side 29, and holding element 7, a friction locking is thus formed in a direction 31 perpendicular to preloading direction 22. Correspondingly, a friction locking is also formed in direction 31 between decoupling element 9, which abuts against lower side 30, and holding element 7. A sufficient retention force in and counter to direction 31 is able to be generated here within certain limits via preloading of decoupling elements 8, 9. If desired, a form-locking connection may also be formed between holding element 7 and at least one of decoupling elements 8, 9, as described by way of example on the basis of formations 25 through 28.

During assembly, a suitably selected assembly force is applied to preloading element 10 in preloading direction 22. Decoupling elements 8, 9 are thereby preloaded. In so doing, utilization is made of the fact that preloading element 10 is displaceable relative to fastening body 5, so that the placement of preloading element 10 relative to fastening body 5 is specifiable upon assembly. In this predefined placement or position of preloading element 10 relative to fastening body 5, preloading element 10 is then joined to fastening body 5. The preloading of decoupling elements 8, 9 is thereby set. For example, within the course of a series production, in this way a predefined preloading of decoupling elements 8, 9 may be set, regardless of component variances occurring. In addition, a desired preloading may also be set individually in terms of the specific application case. Furthermore, a modular assembly may also be realized where, for example, holding element 7 and/or decoupling elements 8, 9 is/are dimensioned differently in view of the specific application case. The desired preloading may then always be set when working with such a modular assembly, as well.

The force transmission from preloading element 10 via decoupling element 8, holding element 7 and decoupling element 9 to supporting element 24 is closed via fastening body 5, as illustrated by closed curve 32. The preloading of decoupling elements 8, 9 and the impingement of decoupling elements 8, 9 during operation in response to a deflection of holding element 7 relative to fastening body 5 is therefore independent of the attachment of fastening body 5 to internal combustion engine 4, as illustrated by closed curve 17.

When the predefined preloading of decoupling elements 8, 9 is set by the placement of preloading element 10, preloading element 10 is then preferably fixed in its position. This may be accomplished by a material-locking and/or form-locking connection.

In a modified embodiment, a press fit may also be formed between preloading element 10 and fastening body 5. For this purpose, inner contact surface 20 of preloading element 10 and outer surface 21 of fastening body 5 are shaped in such a way that after assembly, preloading element 10 is joined to fastening body 5 by the press fit formed between inner contact surface 20 of preloading element 10 and outer surface 21 of fastening body 5. This may also be combined with a further type of connection, depending on the application case. Decoupling elements 8, 9 are then preloaded by preloading element 10 against supporting element 24 over the operational lifetime.

In this exemplary embodiment, decoupling elements 8, 9 surround fastening body 5 circumferentially. Decoupling elements 8, 9 are shaped here as ringlike decoupling elements 8, 9 and preferably are axially symmetric relative to longitudinal axis 23. At least a portion of holding element 7 in the area of interaction with decoupling elements 8, 9 is preferably ringlike, as well. Correspondingly, preloading element 10 and supporting element 24 are preferably also axially symmetric relative to longitudinal axis 23.

In forming the connection between preloading element 10 and fastening body 5, it is also possible during assembly to predefine a distance 33 between preloading element 10 and supporting element 24. Upon assembly, the preloading may then be set in a manner that the assembly device moves preloading element 10 into the position, predefined by distance 33, relative to fastening body 5. In particular, distance 33 may be a defined measure of press-in 33, if preloading element 10 is joined to fastening body 5 by a press fit. Thus, a path-controlled adjustment of the preloading of decoupling elements 8, 9 is possible.

Figure 2:
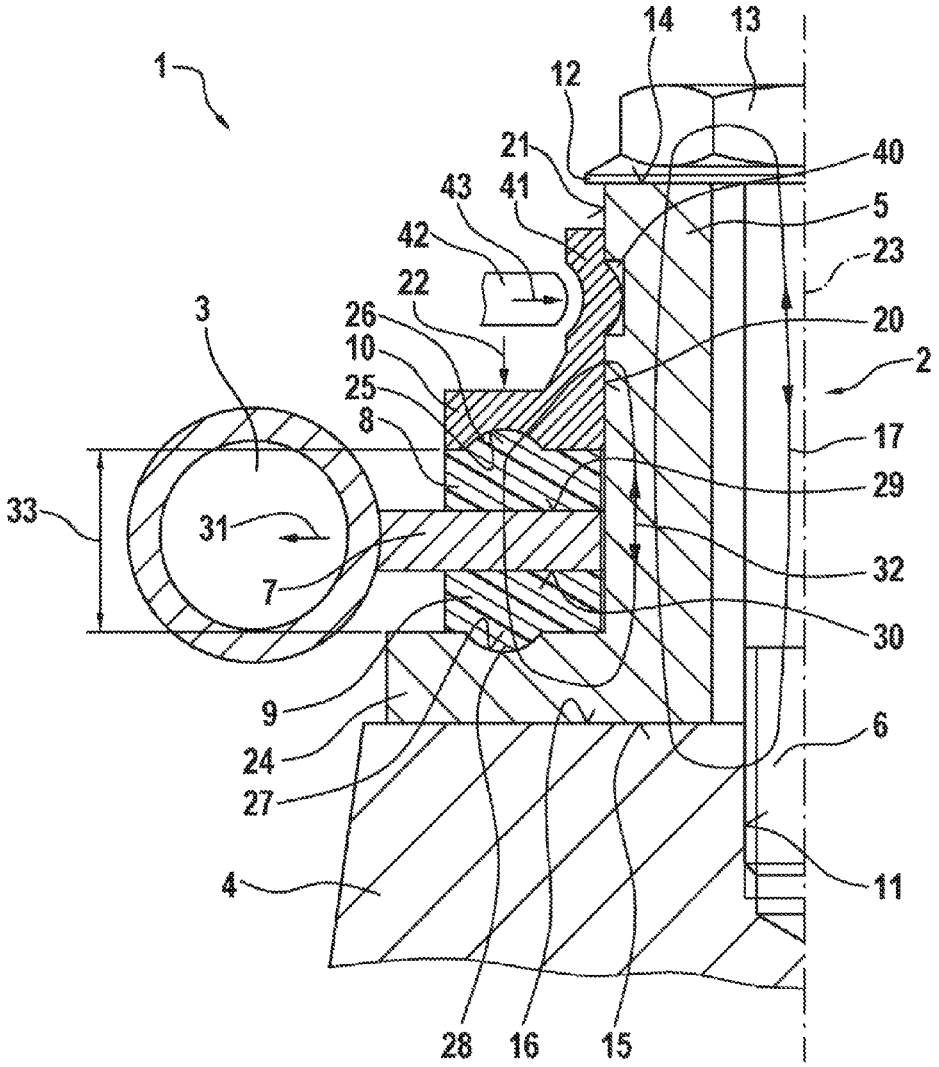
FIG. 2 shows a system having a retainer and a fuel distributor and an internal combustion engine in a partial, schematic sectional view according to a second exemplary embodiment of the present invention.

FIG. 2 shows a system having a retainer 2 and a fuel distributor 3 and an internal combustion engine 4 in a partial, schematic sectional view according to a second exemplary embodiment. In this exemplary embodiment, fastening body 5 has at least one depression 40 on its outer surface 21 In addition, preloading element 10 has a deformable projection 41 which is provided at least in the area of depression 40 of fastening body 5 on outer surface 21 of fastening body 5. Deformable projection 41 of preloading element 10 preferably surrounds outer surface 21 of fastening body 5 circumferentially. By preference, inner contact surface 20 of preloading element 10 abuts against outer surface 21 of fastening body 5. However, inner contact surface 20 may also be set apart somewhat from outer surface 21.

During assembly, first of all, an assembly device acts upon preloading element 10 in preloading direction 22. This may be accomplished in force-controlled fashion. A path-controlled adjustment of the preloading of decoupling elements 8, 9 may also be attained over a defined distance 33. In the predefined position of preloading element 10 relative to fastening body 5, deformable projection 41 is deformed somewhat into depression 40 during assembly by a flanging tool 42, which is affixed in the area of depression 40, and to which a flanging force is applied in a direction 43. Thus, a form-locking connection is realized by flanging. In the predefined position of preloading element 10 relative to fastening body 5 in which preloading element 10 is joined to fastening body 5 by flanging, the preloading of decoupling elements 8, 9 is set after assembly.

Figure 3:
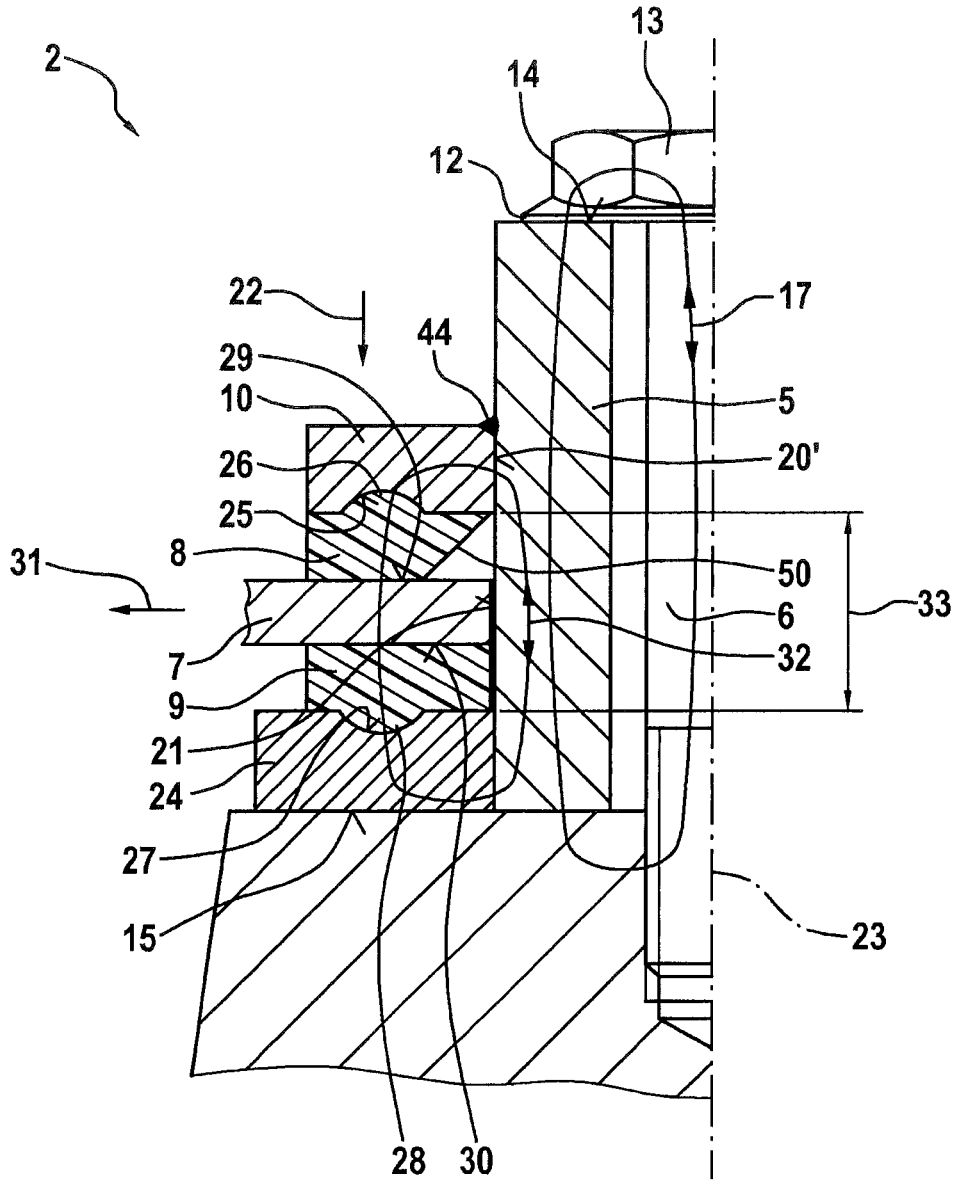
FIG. 3 shows a retainer of the system shown in FIG. 1 in a partial, schematic sectional view according to a third exemplary embodiment of the invention.

FIG. 3 shows a retainer 2 of system 1 shown in FIG. 1 in a partial, schematic sectional view according to a third exemplary embodiment. In this exemplary embodiment, an assembly force is first applied to preloading element 10 in preloading direction 22. The preloading of decoupling elements 8, 9 is thereby set. Preloading element 10 is then joined to fastening body 5 by a welded seam 44. Thus, a material-locking connection of preloading element 10 to fastening body 5 is formed in the predefined position of preloading element 10 relative to fastening body 5.

Figure 4:
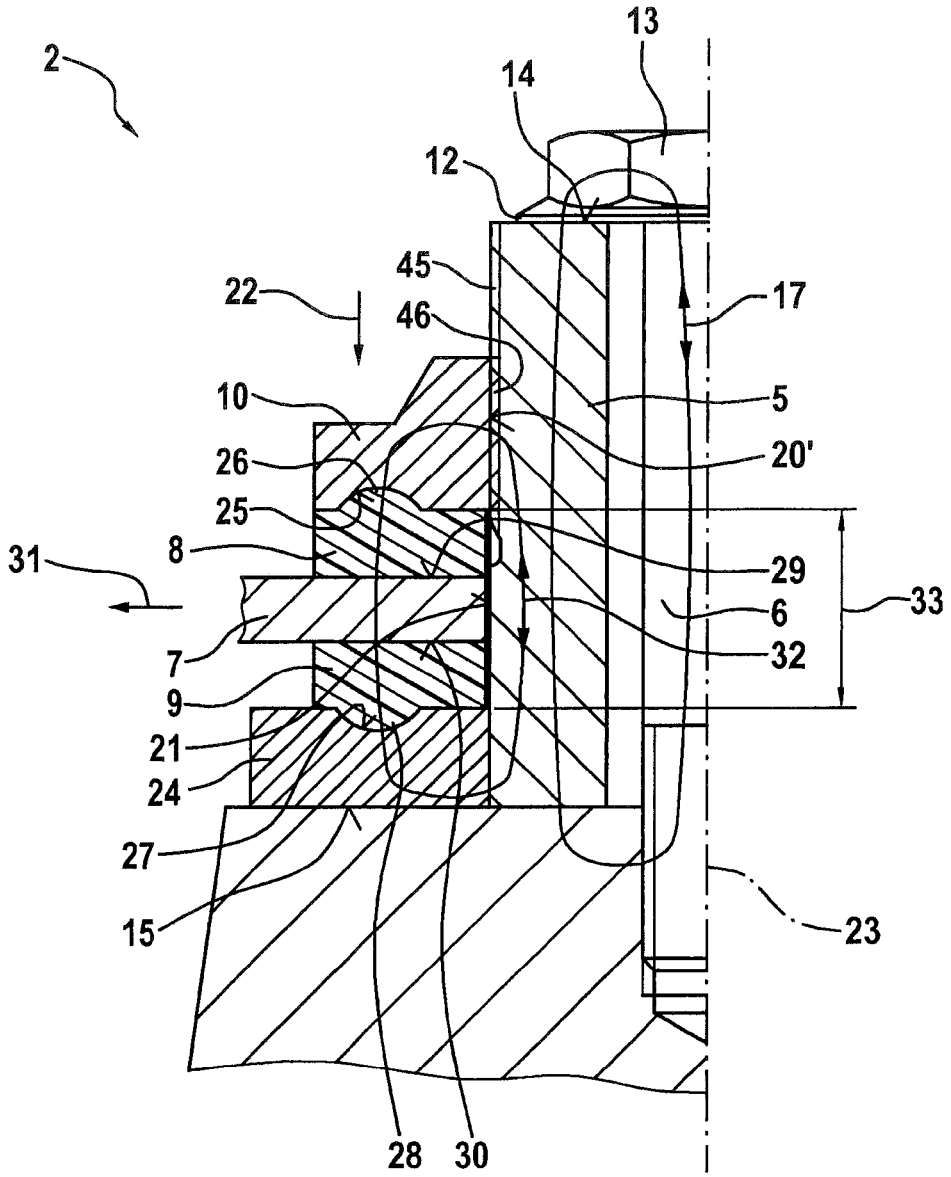
FIG. 4 shows a retainer of the system shown in FIG. 1 in a partial, schematic sectional view according to a fourth exemplary embodiment of the invention.

FIG. 4 shows a retainer 2 of system 1 shown in FIG. 1 in a partial, schematic sectional view according to a fourth exemplary embodiment. In this exemplary embodiment, fastening body 5 has an external thread 45 on its outer surface 21. In addition, preloading element 10 has an internal thread 46 on an inner surface 20'. Preloading element 10 is screwed with internal thread 46 onto external thread 45 of fastening body 5. A form-locking connection is created via the threaded connection between preloading element 10 and fastening body 10. In this case, adjustability is possible after a certain time of service or an anticipated aging. Here, preloading element 10 may be screwed onto fastening body 5 to a predefined distance 33. The preloading of decoupling elements 8, 9 is thus adjustable. If desired, preloading element 10 may also be fixed in its position in suitable manner.

Figure 5:
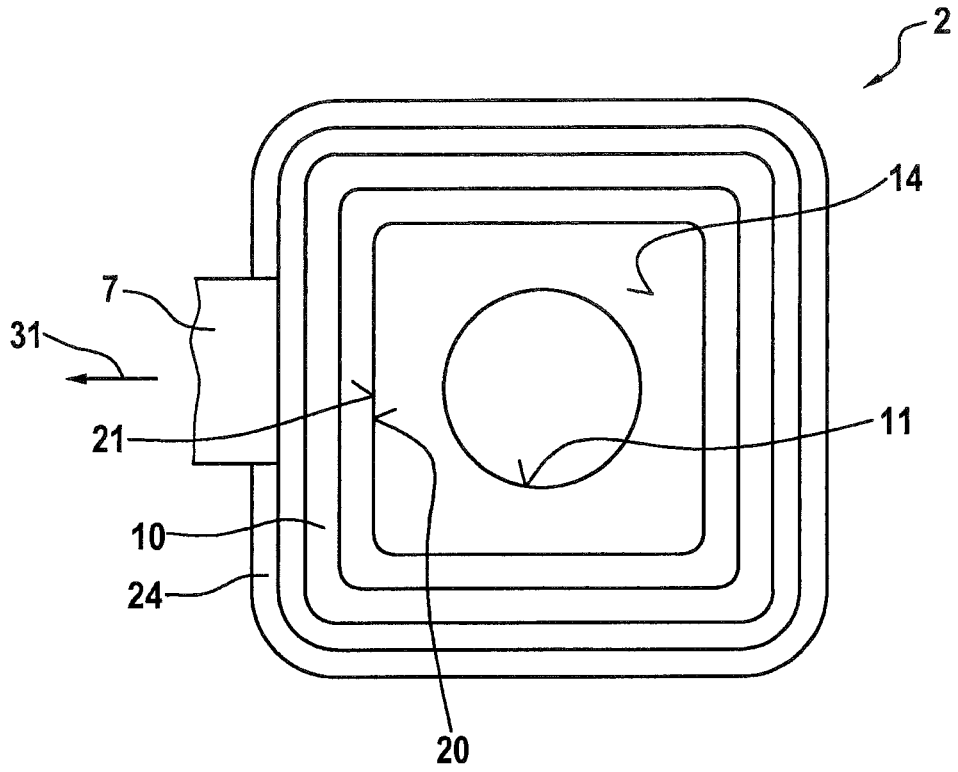
FIG. 5 shows the retainer shown in FIG. 1 in a partial, schematic representation from the direction of view denoted by V according to a fifth exemplary embodiment of the present invention.

FIG. 5 shows the retainer, illustrated in FIG. 1, in a partial, schematic representation from the direction of view denoted by V according to a fifth exemplary embodiment. In this exemplary embodiment, a non-axially symmetric design is realized. In this case, preloading element 10 and decoupling elements 8, 9 are at least approximately rectangularly bent and ringlike. Between inner contact surface 20 of preloading element 10 and outer surface 21 of fastening body 5, a sliding fit is formed by suitable shaping. In the predefined position, preloading element 10 may then be fixed in position in suitable manner on fastening body 5.

By a suitable formation of at least one decoupling element 8, 9, a non-linear spring characteristic may be predefined, especially along preloading direction 22, which describes a dependency of a restoring force, acting on holding element 7, on a deflection of holding element 7 relative to fastening body 5. For example, in the case of decoupling element 8 described with reference to FIG. 3, a chamfer 50 is provided, whereby upon adjustment of holding element 7 counter to preloading direction 22, the spring constant gradually increases, since chamfer 50 is increasingly overcompressed. Therefore, by the formation of decoupling element 8, at least along preloading direction 22 in which decoupling element 8 is preloaded by the placement of preloading element 20 relative to fastening body 5, a non-linear spring characteristic may be predefined. By the preloading, a starting point is then set, so to speak, on this non-linear spring characteristic. Such non-linear spring characteristics may also be predefined in other spatial directions by a suitable formation of the decoupling element.

The present invention is not limited to the exemplary embodiments described.

What is claimed is:

1. A retainer for fastening a component via a holding element to an internal combustion engine, comprising:

at least one decoupling element;

a fastening body surrounding at least a portion of a fastening element;

and a preloading element;

wherein:

the fastening body is configured to be fastened to the internal combustion engine with the aid of the fastening element;

the holding element is configured to be fastened to the fastening body via the at least one decoupling element;

the preloading element is configured to be joined at least indirectly to the fastening body; and a preloading force on the at least one decoupling element is set, independently of a force used to fasten the fastening body to the internal combustion engine using the fastening element, by a specifiable position of the preloading element relative to the fastening body in which the preloading element is joined to the fastening body.

2. The retainer as recited in claim 1, wherein the preloading element has an inner contact surface with which the preloading element abuts against an outer surface of the fastening body.

3. The retainer as recited in claim 2, wherein:

the fastening body has at least one depression on the outer surface;

the preloading element has a deformable projection; and the deformable projection and the at least one depression of the fastening body are shaped in such a way that the preloading element is configured to be joined to the fastening body by flanging.

4. The retainer as recited in claim 2, wherein the inner contact surface of the preloading element and the outer surface of the fastening body are shaped to form a sliding fit between the inner contact surface of the preloading element and the outer surface of the fastening body.

5. The retainer as recited in claim 2, wherein the inner contact surface of the preloading element and the outer surface of the fastening body are shaped to enable the preloading element to be joined to the fastening body by a press fit formed between the inner contact surface of the preloading element and the outer surface of the fastening body.

6. The retainer as recited in claim 2, further comprising:

a supporting element which is joined to the fastening body, wherein the decoupling element is preloaded at least indirectly against the supporting element by the preloading element.

7. The retainer as recited in claim 2, wherein at least one of (i) the decoupling element surrounds the fastening body, and (ii) the decoupling element is shaped as an at least approximately rectangularly bent, ring-like decoupling element.

8. A system, comprising:

a component;

a holding element to hold the component; and a retainer configured to fasten the component to an internal combustion engine, the retainer including:

at least one decoupling element;

a fastening body surrounding at least a portion of the fastening element;

and a preloading element;

wherein:

the fastening body is configured to be fastened to the internal combustion engine with the aid of the fastening element;

the holding element is configured to be fastened to the fastening body via the at least one decoupling element, and the holding element is joined to the component;

the preloading element is configured to be joined at least indirectly to the fastening body; and a preloading force on the at least one decoupling element is set, independently of a force used to fasten the fastening body to the internal combustion engine using the fastening element, by a specifiable position of the preloading element relative to the fastening body in which the preloading element is joined to the fastening body.

9. The system as recited in claim 8, wherein one of:

(i) the preloading element is joined to the fastening body by at least one of welding, flanging, and a press fit; or (ii) the preloading element is screwed with an internal thread of the preloading element onto an external thread of the fastening body.

10. The system as recited in claim 8, wherein the at least one decoupling element is configured such that, at least along a preloading direction in which the at least one decoupling element is preloaded by way of the position of the preloading element relative to the fastening body, a non-linear spring characteristic is predefined which describes a dependency of a restoring force, acting on the holding element, on a deflection of the holding element relative to the fastening body.

* * * * *